United States Patent [19]

Hayashi

[11] Patent Number: 5,041,822

[45] Date of Patent: Aug. 20, 1991

[54] LIQUID CRYSTAL DISPLAY UNIT

[75] Inventor: Yuji Hayashi, Kanagawa, Japan

[73] Assignee: Sony Corporation, Tokyo, Japan

[21] Appl. No.: 453,924

[22] Filed: Dec. 20, 1989

[51] Int. Cl.[5] ..... G09G 3/36

[52] U.S. Cl. ..... 340/784; 340/719; 359/59

[58] Field of Search ..... 340/784, 718, 719, 805, 340/712; 350/331 R, 332, 333, 334, 336; 358/241

[56] References Cited

U.S. PATENT DOCUMENTS

| | | | |
|---|---|---|---|
| 4,728,175 | 3/1988 | Baron | 350/333 |
| 4,818,072 | 4/1989 | Mohebban | 350/331 R |
| 4,839,634 | 6/1989 | More et al. | 340/712 |
| 4,840,462 | 6/1989 | Hartmann | 340/784 |
| 4,899,141 | 2/1990 | Morozumi et al. | 340/784 |
| 4,955,697 | 9/1990 | Tsukada et al. | 340/784 |
| 4,962,413 | 10/1990 | Yamazaki et al. | 350/334 |
| 4,981,340 | 1/1991 | Kurematsu et al. | 350/333 |

FOREIGN PATENT DOCUMENTS

| | | |
|---|---|---|
| 0201838 | 11/1986 | European Pat. Off. . |
| 2904596 | 8/1979 | Fed. Rep. of Germany . |
| 2943206 | 5/1980 | Fed. Rep. of Germany . |

*Primary Examiner*—Jeffery A. Brier
*Assistant Examiner*—M. Fatahiyar
*Attorney, Agent, or Firm*—Hill, Van Santen, Steadman & Simpson

[57] ABSTRACT

A liquid crystal display unit includes a matrix array of pixels composed of liquid crystal cells and switching transistors connected to a horizontal scanner for horizontal scanning of the pixels and to a vertical scanner for vertical scanning of the pixels. Clock pulse input circuits feed clock pulse signals to the scanners and start pulse input circuits feed start pulse signals to the scanners. Electrostatic breakdown of the display unit is prevented by a capacitive element having a load substantially equal to the load on the clock pulse input circuits which is connected to each of the start pulse input circuits to prevent buildup of potential differences between the circuits. In one embodiment, the capacitive elements are reference cells consisting of liquid crystal display cells formed by two mutually opposed electrodes between which is sealed a liquid crystal material.

3 Claims, 4 Drawing Sheets

SRh
2
3
b1
b2
b3
b4
b2n-1
b2n
10h
φh1
12h
11h
φh2
13h
14h
15h
19h
16h
4
φhs
17h
18h
20
22
V
G11
G12
G13
G14
G1(2n)
G1(2n-1)
G2(2n)
G3(2n)
G4(2n)
G(2n-1)(2n)
G(2n)(2n)
G(2n)(2n-1)
G(2n)4
G(2n)3
G(2n)2
G(2n)1
8
9
1
5
SRv
6
10v
12v
φv1
V2
11v
13v
14v
15v
16v
φvs
17v
19v
18v
21
23
7

LIQUID CRYSTAL DISPLAY UNIT

BACKGROUND OF THE INVENTION

The present invention relates to a liquid crystal display unit having a plurality of pixels arrayed in a matrix and, more particularly, to a transmission type liquid crystal display unit in which a thin film transistor array is formed on a glass substrate.

A liquid crystal display unit 31 is shown in FIG. 4 having a plurality of matrix-arrayed pixels G. In the liquid crystal display unit 31 is provided a horizontal scanner 32 for performing horizontal scanning of the pixels G as well as a vertical scanner 33 for performing vertical scanning of the pixels G. Clock pulse input circuits 34 and 35 are connected to input clock pulse signals to the two scanners 32 and 33, and start pulse input circuits 36 and 37 are provided for inputting start pulse signals to the horizontal and vertical scanners 32 and 33, respectively.

The start pulse input circuit 36 for the horizontal scanner 32 is formed of an inverter 38*h* and an input pad 39*h*. The inverter 38*h* outputs a start pulse signal ϕhS which is supplied via the input pad 39*h* to an inverter 40*h* in the horizontal scanner 32. In addition to the inverter 40*h*, the horizontal scanner 32 also includes a shift register SRh which has output leads which correspond in number to the number of pixels G in a horizontal, or x, direction.

The clock pulse input circuit 34 which is connected to the horizontal scanner 32 includes two inverters 41*h* and 42*h*, two input pads 43*h*, and 44*h*, and two branch means 45*h* and 46*h*. The branch means are multiplexers. The inverter 41*h* and 42*h* produce clock pulse signals ϕh1 and ϕh2 of mutually different phases, which are delivered through the input pads 43*h* and 44*h* to the branch means 45*h* and 46*h*. The branch means 45*h* and 46*h* in the illustrated embodiment are connected to supply the clock pulse signals ϕh1 and ϕh2 for the respective even leads and odd leads, or bits, of the horizontal scanner 32.

The start pulse input circuit 37 and the clock input circuit 35 for the vertical scanner 33 are structurally similar to the start pulse input circuit 36 and the clock pulse input circuit 34 for the horizontal scanner 32 and, as such, the same explanation applies here except for any change in the reference numerals. Accordingly, a repeated explanation has been omitted.

The embodiment of FIG. 4 also shows reference cells 47 and 48 which have been used on a trail basis for basic voltage (V-T) measurements or for register control and which are supplied with a source voltage v through pads 49 and 50. The illustrated reference cells 47 and 48 bear no relation to driving of the display.

Generally, in transmission type liquid crystal display units in which a thin film transistor (TFT) array is formed on a glass substrate, there is no limitation to the size of the substrate so that the image display size may be freely selected as desired. Furthermore, since a display electrode substrate using a thin film transistor (TFT) array on a glass substrate permits transmission of light, it is applicable for use both in reflection-type as well as transmission-type displays, while ensuring that the advantages of being capable of displaying a color image when used in conjunction with color filters are achieved.

Another type of liquid crystal display unit which differs from thin filmed transistor arrays is a display unit having a switching MOS field effect transistor (FET) array formed on a silicon substrate which is superimposed on a glass substrate. The silicon substrate has a disadvantage in that it is sensitive to static electricity and further that it is prone to being broken. These disadvantages are not found in the thin film transistor array type displays.

Liquid crystal display units as shown, for example, in FIG. 4 operate, with respect to horizontal scanning, by the clock pulse input circuit 34 supplying clock pulse signals ϕh1 and ϕh2 from the inverters 41*h* and 42*h* via the branch means 45*h* and 46*h* to the individual bits of the scanner 32. The start pulse input circuit 36 supplies only a start pulse signal ϕhS from the inverter 38*h* to the first stage inverter 40*h* in the scanner. Therefore, the load on the start pulse input circuit 36 is far less than the load on the clock pulse input circuit 34. Consequently, even when the start pulse input circuit 36 is initially placed under the same electrostatic condition as the clock pulse input circuit 34, the voltage in the start pulse input circuit 36 is prone to being raised higher than on any other lead. Thus, a voltage difference builds up between the start pulse input circuit 36 and the power source or clock line which eventually causes static breakdown of a gate oxide film or the like in the inverter 40*h*. A similar breakdown can occur in the vertical scanner 33 as well.

SUMMARY OF THE INvENTION

It is an object of the present invention to provide a highly reliable liquid crystal display unit wherein the load at the start pulse input circuit and the load at the clock pulse input circuit are substantially equal to each other to prevent the occurrence of static breakdown which may otherwise occur in the display driving circuit.

According to one aspect of the present invention, there is provided an improved liquid crystal display unit having a plurality of matrix arrayed pixels each composed of a liquid crystal cell and having a switching transistor applied to each cell, a horizontal scanner for horizontally scanning the pixels, a vertical scanner for vertically scanning the pixels, clock pulse input circuits for feeding clock pulse signals to the horizontal and vertical scanners, start pulse input circuits for feeding a start pulse signal to the two scanners, and a capacitive element connected to each of the start pulse input circuits and being of a capacitance so that the load on the start pulse input circuits is substantially equal to the load on the clock pulse input circuits.

According to another aspect of the invention, there is provided an improved liquid crystal display unit wherein each of the capacitive elements is a reference cell connected to each of the start input circuits and being of a load substantially equivalent to the load at each of the clock pulse input circuits.

A further aspect of the invention provides that the reference cells of the improved liquid crystal display unit each consisting of a liquid crystal display cell composed of two mutually opposed electrodes and a liquid crystal material sealed in between the two electrodes.

When the liquid crystal display unit is so constructed, even when the start pulse input circuits are placed under the same electrostatic condition as the clock pulse input circuits, the potentials at the input pads of the start pulse input circuits are raised to similar level as those of the clock pulse input circuits of these power supply line, so that no potential difference is caused between the start pulse input circuits and the clock pulse input circuits by the power supply line. Thus, electrostatic breakdown which may otherwise be induced in the gate oxide film or the like of the inverter is successfully prevented to ensure high reliability of the present liquid crystal display unit.

DESCRIPTION OF THE PREFERRED EMBODIMENTS

Figure 1:
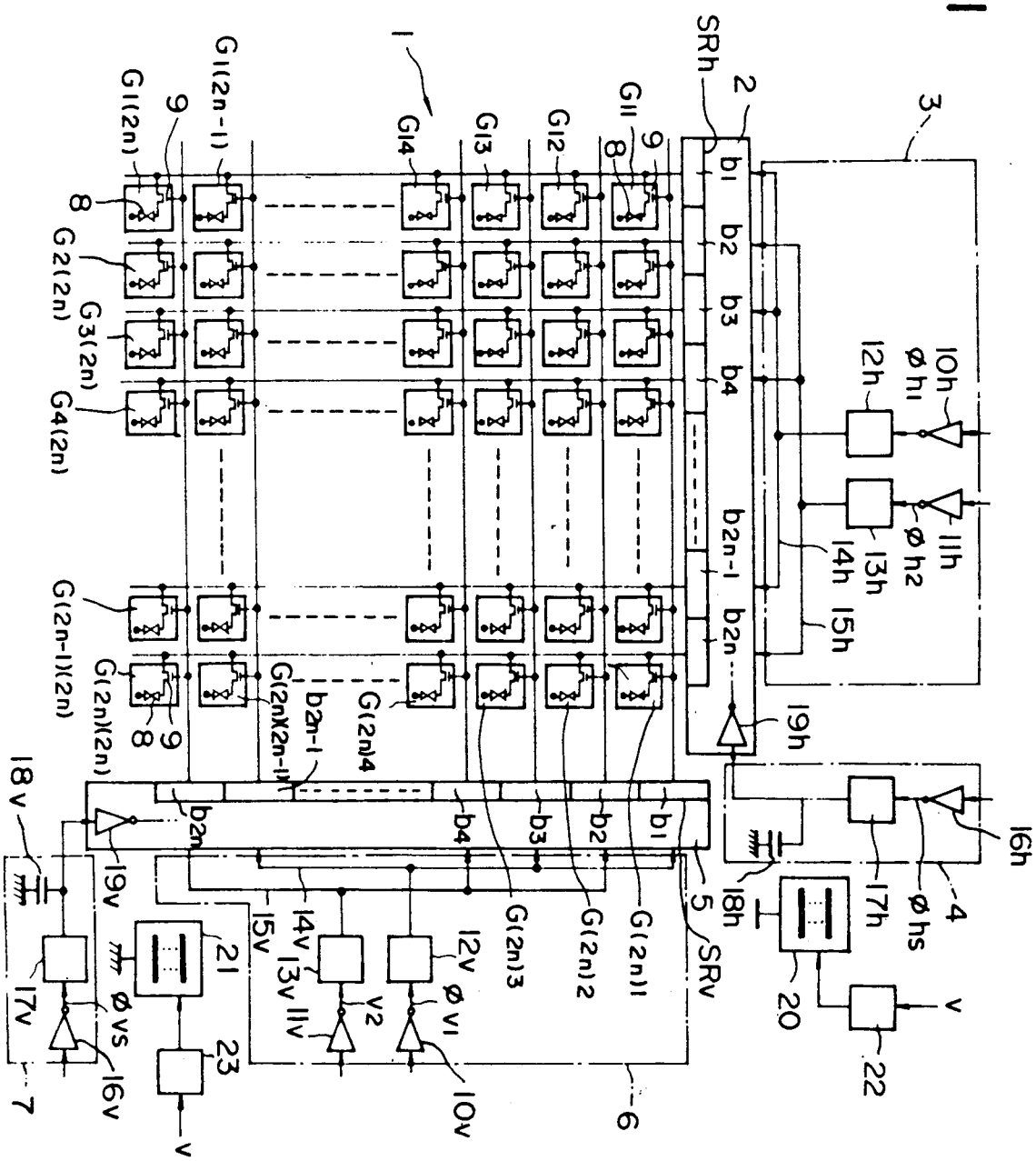
FIG. 1 is a schematic block diagram of a liquid crystal display unit embodying the principals of the present invention.

Exemplary embodiments of the present invention are described hereinafter with reference to FIGS. 1 through 3. In FIG. 1 is shown a schematic block diagram of the constituent parts of a liquid crystal display unit according to the present invention. In FIG. 1 there is shown a liquid crystal display unit 1 as a whole, a horizontal scanner 2, a clock pulse input circuit 3 and a start pulse input circuit 4 for the horizontal scanner 2, a vertical scanner 5, and a clock input circuit 6 and a start pulse input circuit 7 for the vertical scanner 5.

The liquid crystal display unit 1 is formed of a plurality of pixels G, such as the pixels G11, G12, G13, etc. which are arranged both horizontally and vertically to form a matrix array. Each pixel, such as the pixel G11, is formed of a liquid crystal cell 8 and an accompanying switching transistor 9. In the preferred embodiment, the switching transistors 9 are thin film transistors formed on a glass substrate which forms the display panel.

The horizontal scanner 2 consists of a shift register SRh and has bits b1, b2, b3, etc. which correspond numerically at least to the number of horizontal pixels in the display unit 1. Similarly, the vertical scanner 5 consists of a shift register SRv with bits b1, b2, b3, etc. that numerically correspond at least to the number of vertical pixels in the display unit 1. A clock pulse input circuit 3 for the horizontal scanner 2 includes two inverters 10*h* and 11*h*, two clock pulse input pads 12*h* and 13*h*, and branch means (such as multiplexers) 14*h* and 15*h* for supplying clock pulse signals $\phi$h1 and $\phi$h2 of mutually different phases in parallel from the inverters 10*h* and 11*h* via the input pads 12*h* and 13*h* to the horizontal scanner 2. The input pads 12*h* and 13*h* are in the form of metal pads on the display panel to which wires are bonded to serve as input terminals for display panel from the inverters 10*h* and 11*h*. In illustrated embodiment, the clock pulse signals $\phi$h1 and $\phi$h2 are supplied to the odd bits and even bits of the horizontal scanner 2, respectively. It follows, therefore, that the odd bit load and the even bit load of the horizontal scanner 2 are imposed on the clock pulse input circuit 3, and particularly at the input pads 12*h* and 13*h* thereof, respectively. In the drawings, the branch means 14*h* and 15*h* are illustrated in the form of circuit branches for convenience.

Meanwhile, the start pulse input circuit 4 for the horizontal scanner 2 includes a inverter 16*h*, a start pulse input pad 17*h* and a capacitor 18*h*. The start pulse input signal $\phi$hs from the inverter 16*h* is supplied through the input pad 17*h* to the inverter 19*h* of the horizontal scanner 2. The capacitor 18*h* is connected between the output of the pad 17*h* and ground and has a capacitance such that the load on the start pulse circuit 4 is substantially equivalent to the load imposed on the clock pulse input circuit 3. It, therefore, follows that the total load of both the inverter 19*h* and the capacitor 18*h* is imposed on the start pulse input circuit 4, and in particular at the input pad 17*h* thereof. As a result thereof, the start pulse input circuit 4 has substantially the same load as the clock pulse input circuit 3 so that no voltage build-up occurs, thereby eliminating the source of breakdown.

A substantially similar arrangement is provided for the vertical scanner, including the addition of a capacitor 18*v* at the vertical start pulse input circuit 7.

Figure 2:
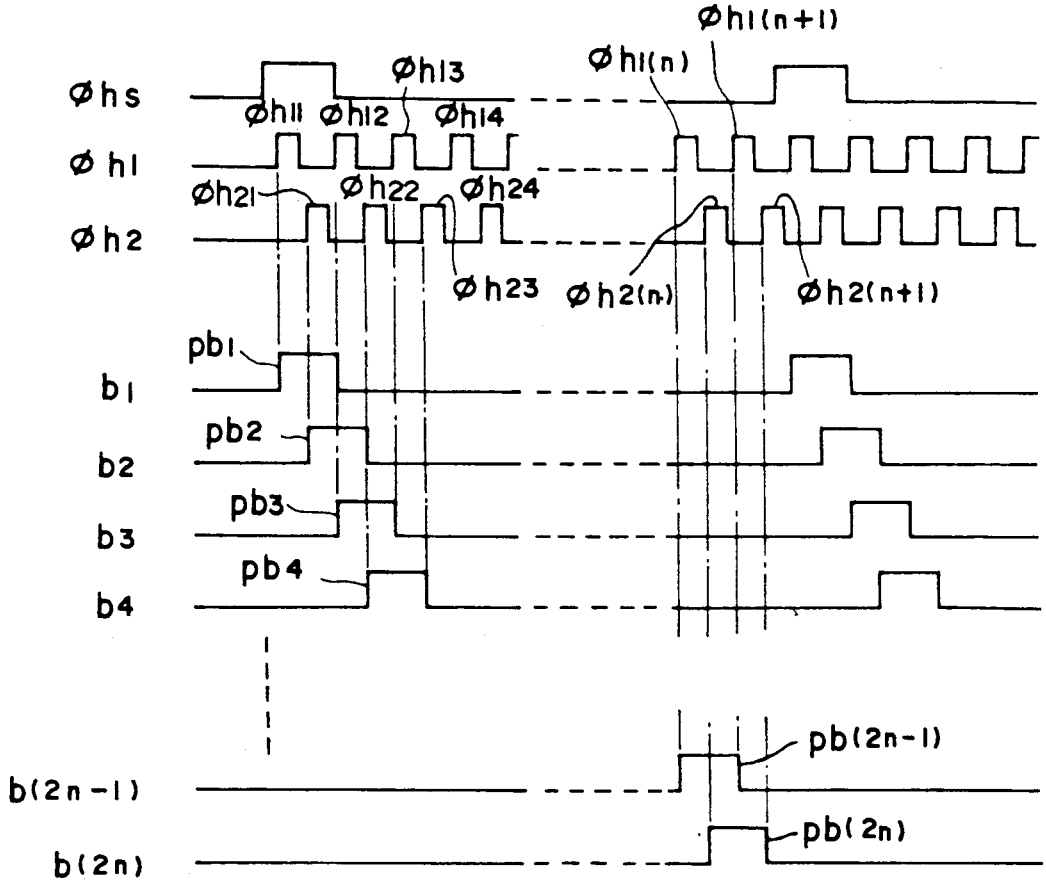
FIG. 2 is a timing chart of start pulse signals and clock pulse signals appearing in the liquid crystal display units.
Figure 3:
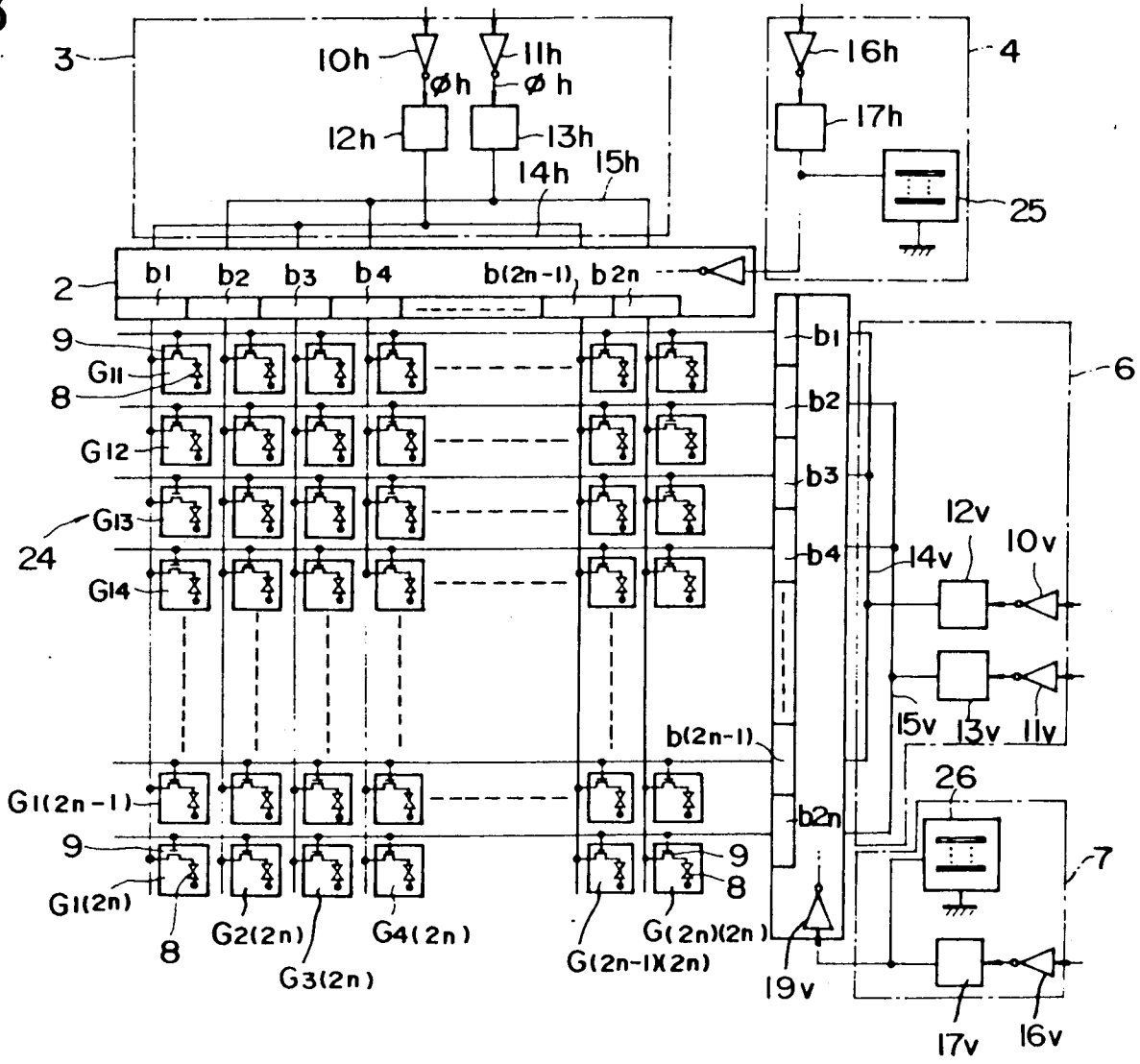
FIG. 3 is a schematic block diagram of a second embodiment of the present invention.
Figure 4:
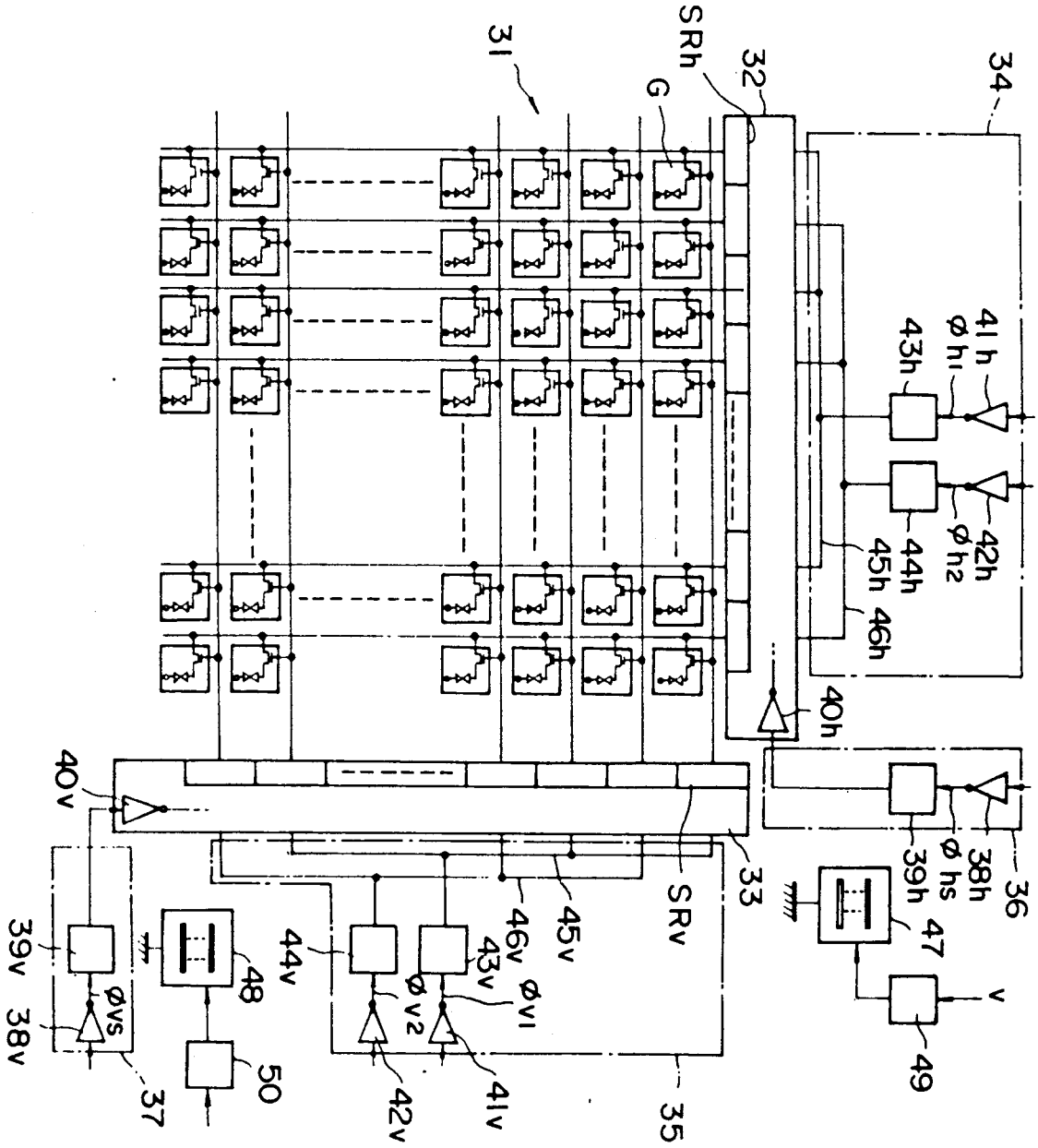
FIG. 4 is a schematic block diagram of a liquid crystal display unit.

FIG. 2 shows a timing diagram of the start of pulse signals $\phi$hs, the clock pulse signals $\phi$h1, $\phi$h2 and the signals to the odd bits and even bits in the horizontal scanner 2, such as the signals pb1, pb2, pb3, and pb4.

In response to the supply of a start pulse signal $\phi$hs to the inverter 19*h*, the first clock pulse signal $\phi$h1 and the second clock pulse signal $\phi$h2 are supplied alternately to the horizontal scanner. For example, one pulse signal pb1 which rises synchronously with the rise of an initial first clock pulse signal $\phi$h11 and immediately after supply of the start pulse signal $\phi$hs and follows synchronously with the fall of a next first clock pulse signal $\phi$h12 is supplied to the first bit b1 in the horizontal scanner 2. Subsequently, there is supplied to the third bit b3, one pulse signal pb3 which rises synchronously with the rise of the second first clock pulse signal $\phi$h12 and falls synchronously with the rise of a third first clock pulse signal $\phi$h13. Sequential supply of the pulse signals is executed in this manner. There is supplied to the (2n-1)th odd bit b(2n-1) one pulse signal pb(2n-1), which rises synchronously with the rise of the nth first clock pulse signal $\phi$h1(n) and falls synchronously with the rise of the (n+1)th first clock pulse signal $\phi$h1(n+1).

Similarly there is supplied to the 2nth even bit b(2n) one pulse signal pb(2n) which rises synchronously with the rise of the nth second pulse $\phi$h2(n+1) and falls synchronously with the rise of the (n+1)th second clock pulse $\phi$h2(n+1).

Since the clock pulse input 6 and the start input pulse circuit 7 for the vertical scanner 5 are structurally and functionally the same as the clock pulse input circuit 3 and the start pulse input circuit 4 for the horizontal scanner 2, they are represented merely by changing the reference numerals thereof and a repeated explanation is omitted here.

Liquid crystal display units have been made on a trial basis, in which basic measurements (V-T) and register control are executed by means of reference cells 20 and 21 provided in the display unit. The reference cells 20 and 21 are extremely small, independent liquid crystal display cells to which a source voltage V is supplied through a reference input pad 22 and 23, respectively.

In a second embodiment of the invention, these reference cells are utilized for a further purpose as will now be described. In a liquid crystal display unit 24 as shown in FIG. 3, start pulse input circuits 4 and 7 utilize reference cells 25 and 26. In this example, the reference cells 25 and 26 are used in place of capacitors 18*h* and 18*v* in the first embodiment. Each of the reference cells 25 and 26 has a liquid crystal display cell structure in which a liquid crystal material is sealed between upper and lower electrodes and such structure is utilizable as a capacitor. Therefore, in the second embodiment, the reference cells 25 and 26 are formed so that there capacitances are equivalent to those of the capacitors 18*h* and 18*v*. Furthermore, the start pulse input pads 17*b* and 17*v* are used as the reference pads for the reference cells 25 and 26, thereby eliminating the necessity of providing reference input pads 49 and 50. Thus, it is possible to achieve an effective use of the space in the liquid crystal display unit by the present invention as well.

With the exception of the start pulse input circuits 4 and 7, the second embodiment is structurally identical to the aforementioned first embodiment and, therefore, the same or equivalent components are denoted with the same reference numerals and symbols.

According to the first embodiment, the capacitors 18*h* and 18*v* have load capacitances which are substantially equivalent to the loads on the clock pulse input circuits 3 and 6 and are connected to the start pulse input circuits 4 and 7 so that no potential difference arises between the start pulse input circuit 4 and 7 and the clock pulse input circuits 3 and 6 or the power supply line. This consequently prevents electrostatic breakdown which may otherwise be induced in the gate oxide film or the like of the inverters 19*h* and 19*v* in the horizontal and vertical scanners 4 and 5, hence enhancing the reliability of the liquid crystal display unit. In addition, the drivers need not be changed particularly for the reason that the loads of the start pulse input circuits 4 and 7 are light, so that the external loads remain substantially unchanged.

Furthermore, by utilizing the reference cells 25 and 26 in place of the capacitors 18*h* and 18*v* as shown in the second embodiment, it becomes possible to utilize the start pulse input pads 17*h* and 17*v* as the reference input pads to eventually eliminate the necessity of providing additional reference pads. This attains the effective use of the space in the liquid crystal display unit.

As described hereinabove, the liquid crystal display unit of the present invention provides capacitive elements having loads substantially equivalent to those of clock pulse input circuits which are connected to the start pulse input circuits of the scanners which perform horizontal and vertical scanning on a plurality of pixels arranged in a matrix array. Accordingly, this prevents any electrostatic breakdown from being induced in the conventional liquid crystal display unit to consequently enhance the reliability of the display unit.

Although other modifications and changes may be suggested by those skilled in the art, it is the intention of the inventor to embody within the patent warranted hereon all changes and modifications as reasonably and properly come within the scope of his contribution to the art.

I claim:

1. A liquid crystal display unit, comprising:

a plurality of pixels arrayed in a matrix, each pixel being composed of a liquid crystal cell and having a switching transistor;

a horizontal scanner connected to horizontally scan said pixels;

a vertical scanner connected to vertically scan said pixels;

clock pulse input circuits connected to feed a clock pulse signal to said horizontal and vertical scanners;

start pulse input circuits connected to feed a start pulse signal to said horizontal and vertical scanners; and a capacitive element connected to each of said start pulse input circuits, each of said capacitive elements being of an electrical load substantially equivalent to a load at each of said clock pulse input circuits whereby the electrostatic voltage breakdown of the display unit is prevented.

2. A liquid crystal display unit according to claim 1, wherein said capacitive elements are reference cells of a load substantially equivalent to a load at each of said clock pulse input circuits.

3. A liquid display unit according to claim 2, wherein said reference cell consists of a liquid crystal display cell composed of two mutually opposed electrodes and a liquid crystal material sealed in between said two electrodes.

* * * * *